United States Patent [19]

Cox

[11] Patent Number: 4,854,502

[45] Date of Patent: Aug. 8, 1989

[54] RECYCLING SPRAY APPARATUS FOR LOUNGE

[76] Inventor: Roger D. Cox, 1264 Twin Oak Dr., Winston Salem, N.C. 27105

[21] Appl. No.: 250,667

[22] Filed: Sep. 29, 1988

[51] Int. Cl.[4] ..... A47C 7/74; B05B 17/00

[52] U.S. Cl. ..... 239/124; 239/289; 297/180

[58] Field of Search ..... 239/124, 126, 127, 207, 239/279, 289, 547, 550; 128/366, 372, 376; 297/180, 217; 5/418, 421

[56] References Cited

U.S. PATENT DOCUMENTS

| | | | |
|---|---|---|---|
| 3,295,886 | 1/1967 | Goldmerstein | 297/180 |
| 3,625,434 | 12/1971 | Kitover | 239/289 |
| 3,688,775 | 9/1972 | Raymann | 239/289 |
| 4,141,585 | 2/1979 | Blackman | 297/180 |
| 4,151,618 | 5/1979 | Carpenter | 5/421 |
| 4,237,561 | 12/1980 | Britton | 128/366 |
| 4,548,357 | 10/1985 | Schmidt | 239/289 |
| 4,675,923 | 6/1987 | Ashley | 128/366 |
| 4,765,542 | 8/1988 | Carlson | 239/289 |

*Primary Examiner*—Andres Kashnikow
*Assistant Examiner*—Karen Merritt
*Attorney, Agent, or Firm*—Henderson & Sturm

[57] ABSTRACT

A recycling spraying apparatus (10) for lounge chairs (100) wherein the recycling spraying apparatus (10) comprises: a collection unit (11) suspended beneath the lounge chair (100); a sump pump unit (12) in fluid communication with a spraying unit (13), wherein a system liquid may be recirculated between the sump pump unit (12); the spraying unit (13); the lounge chair (100); and the collection unit (11).

9 Claims, 1 Drawing Sheet

FIG. 1.
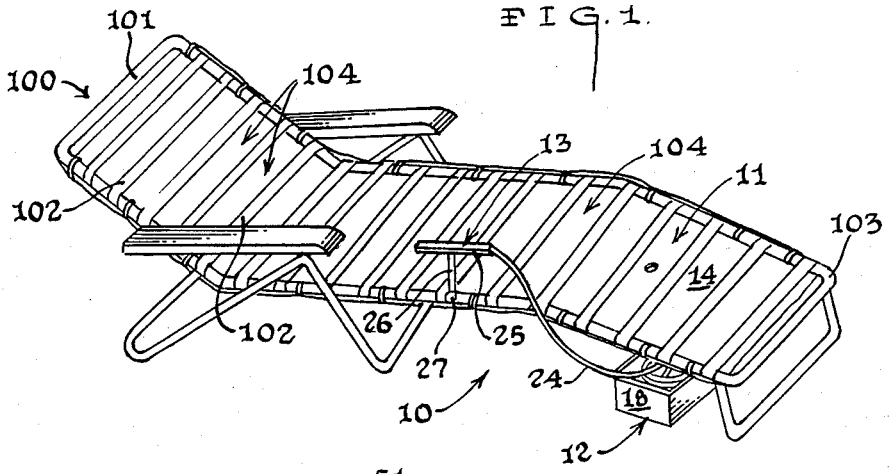
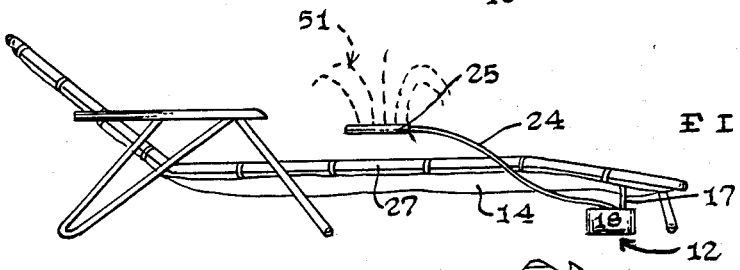
FIG. 2.
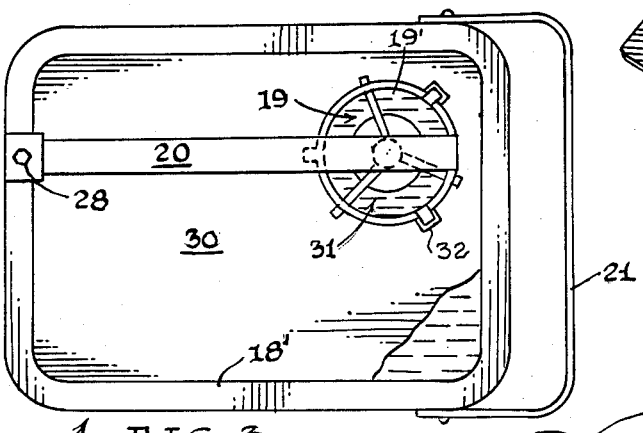
FIG. 3.
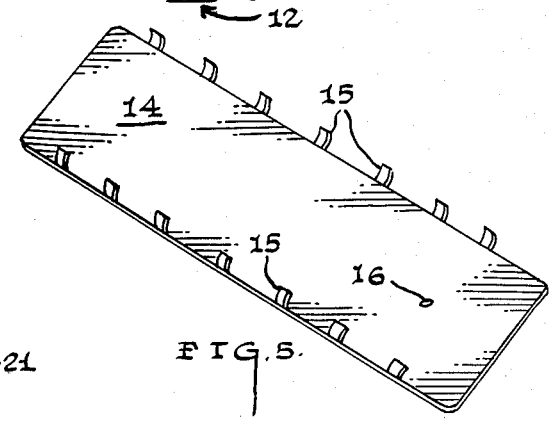
FIG. 5.
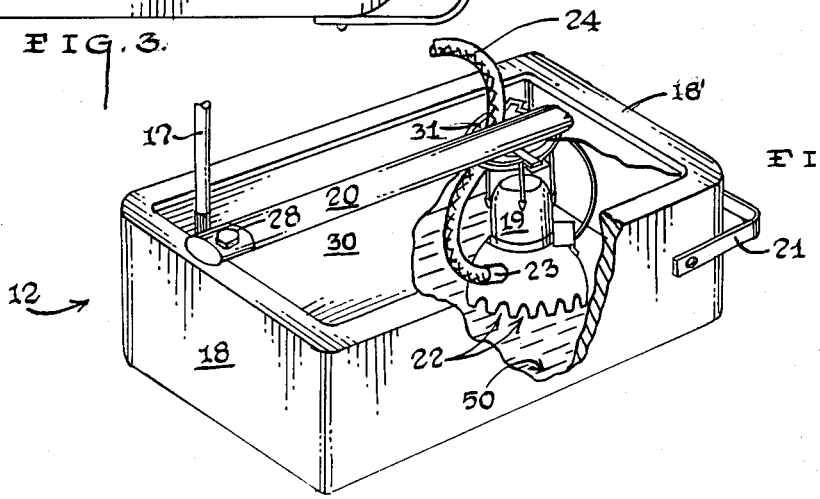
FIG. 4.

RECYCLING SPRAY APPARATUS FOR LOUNGE

TECHNICAL FIELD

This invention relates to spraying apparatus in general and more specifically to a recycling spraying apparatus for lounge chairs.

BACKGROUND OF THE INVENTION

As can be seen by reference to the following U.S. Pat. Nos. 3,625,434; 4,548,357; 4,141,585; and 3,295,886 the prior art is replete with myriad and diverse forced fluid projecting apparatus that are used in conjunction with a chaise lounge structure to provide cooling fluid currents to a person disposed in a recumbent position on the lounge chair.

While all of the aforementioned prior art patents are at least adequate for the basic purpose and function for which they have been specifically designed, these previous constructions have been woefully inadequate in a number of design and performance respects.

To begin with, virtually all of the prior art constructions have involved extensive modifications to the lounge chair structure; and, in most instances the cooling fluid is circulated through and propelled from the interior of the framework that comprises the lounge chair.

In addition, in those instances wherein the cooling fluid comprises a liquid such as water, the prior art constructions make no provision for either the capturing or recycling of the liquid. As a direct consequence of this oversight, the liquid tends to pool around the periphery of the lounge chair thereby creating an unsightly not to mention potentially hazardous condition.

Based on the foregoing situation there has existed a longstanding need among those individuals most closely related with this area of technology for an improved spraying apparatus for lounge chairs that would avoid all of the drawbacks and deficiencies that are represented in the prior art constructions.

BRIEF SUMMARY OF THE INVENTION

Briefly stated, the recycling spraying apparatus for lounge chairs that forms the basis of the present invention comprises in general: a collection unit, a sump pump unit, and a spraying unit; wherein, the collection unit is suspended beneath at least a portion of the lounge chair and the outlet of the collection unit feeds directly to the sump pump unit; whereby the output of the sump pump unit is forced through the spraying unit.

By virtue of this arrangement an initial volume of cooling fluid can be recycled through this apparatus numerous times before the system liquid will have to be replenished. In addition, the recycling of the system liquid will recapture and recirculate any tanning lotion that has been washed off the users person by the action of the spraying unit, whereupon the tanning oils will be redeposited on the users skin during subsequent absolutions.

It should also be noted that tanning oils may also be initially introduced into the system liquid so that the user will not have to apply the oils directly onto their skin, but may instead rely on the continual application of the tanning oils suspended in the system liquid to apply and maintain a fairly constant coating of tanning oil on their bodies.

BRIEF DESCRIPTION OF THE DRAWINGS

These and other objects, advantages, and novel features of the invention will become apparent from the detailed description of the best mode for carrying out the invention which follows; particularly when considered in conjunction with the accompanying drawings, wherein:

FIG. 1 is a perspective view of the recycling spraying apparatus installed on a lounge chair;

FIG. 2 is a side elevational view of the structure depicted in FIG. 1;

FIG. 3 is an isolated top plan view of the sump pump unit;

FIG. 4 is an isolated detailed perspective view of the sump pump unit; and,

FIG. 5 is an isolated perspective view of the collection unit.

BEST MODE FOR CARRYING OUT THE INVENTION

As can be seen by reference to the drawings and in particular to FIGS. 1 and 2, the recycling spraying apparatus that forms the basis of the present invention is designated generally by the reference numeral (10). The apparatus (10) comprises in general: a collection unit (11); a sump pump unit (12); and a spraying unit (13) adapted to cooperate with a conventional lounge chair construction (100). These units will now be described in seriatim fashion.

Prior to embarking on a discussion of the recycling spraying apparatus (10), it should be noted that the conventional lounge chair construction (100) that is to be used in conjunction with the apparatus (10) comprises a lounge chair framework (101) having a plurality of slats (102) that define openings (104) which will allow the passage of the system liquid by gravity through the lounge chair construction. In addition, in the preferred embodiment of this invention the lounge chair framework (101) comprises tubular framework members (103).

As can best be seen by reference to FIGS. 1, 2, and 5, the collection unit (11) comprises a generally elongated rectangular collection member (14) having a plurality of securing members (15) disposed at spaced locations along at least the two longest opposed sides of the collection member (14); wherein the securing members (15) are adapted to releasably engage the outer periphery of the lounge chair framework (101); whereby the collection member (14) will be suspended beneath at least a portion of the lounge chair (100).

In addition, the collection member (14) is provided with a fluid outlet (16) which is positioned at the lowermost point of the collection member (14); and, the fluid outlet (16) is optionally connected to a downwardly depending hose section (17).

As shown in FIGS. 1 thru 4, the sump pump unit (12) comprises in general: a sump receptacle (18) operatively equipped with a pump member (19) that is powered by a portable power supply (20) such as batteries or the like; wherein, the sump receptacle (18) is further provided with a handle element (21) to facilitate the transport of at least the sump pump unit (12) of the apparatus.

In addition, as can be seen particularly by reference to FIG. 4, the pump member (19) is adapted to sit on the bottom of the sump receptacle (18) wherein the pump inlet ports (22) are disposed proximate the bottom of the sump receptacle (18), and wherein the pump outlet port

(23) is provided with a length of hose (24) that is operatively connected to the spraying unit (13).

As can also be seen by reference to FIGS. 3 and 4, the sump receptacle (18) further comprises a cover member (30) that is recessed below the lip (18') of the sump receptacle (18); wherein, the cover member (30) is provided with sloped surfaces that converge on an enlarged opening (31) formed proximate the end of the sump receptacle (18) that has the handle element (21).

As can best be appreciated by reference to FIG. 3, the enlarged opening (31) in the cover member (30) is provided with a plurality of radially disposed slots (32) that are dimensioned to receive complimentary configured arms (19') on the pump member (19); so that the pump member (19) may be inserted and withdrawn from the interior of the sump receptacle (18).

It should be appreciated at this juncture that the position of the cover member opening (31) is chosen such that the sump receptacle (18) may be filled through the enlarged opening (31) with a substantial volume of water (50) and carried by the handle member (21) over relatively long distances without water (50) spilling out of the opening (31).

It should also be appreciated that the sloped surfaces of the cover member (30) are designed to collect and direct recycled spray water through the enlarged opening (31) into the interior of the sump receptacle (18) in close proximity to the pump member 119). Optionally, however, fluid outlet (16) can be connected to a downwardly depending hose section (17) to direct water directly into the interior of sump receptacle (18).

As can best be seen by reference to FIGS. 1 and 2, the spraying unit (13) comprises an elongated spray head member (25) provided with a downwardly depending support leg (26) having a securing element (27) provided on its lower end; wherein, the securing element is adapted to releasably engage the lounge chair framework (101) for the purpose of supporting and suspending the spray head member (25) above the lounge chair framework (101). Furthermore, the spray head member (25) is in open fluid communication with the outlet (23) of the pump member (19) by virtue of the connection of the length of hose (24) intermediate the spray head member (25) and the pump member (19).

By now it should be fairly obvious how the recycling spray apparatus (10) of this invention cooperates with a lounge chair construction (100). First of all it will be necessary to fill the sump receptacle with a system liquid (50) such as water, or the like; and then selectively position the spray head member (25) at a desired location on the lounge chair framework (101); wherein, the liquid spray (51) will cover a selected portion of the users body.

Prior to activating the pump member (19) by the manipulation of a conventional on/off switch (28), the collection member (14) is suspended beneath the lounge chair framework (101) by use of the securing members (15); wherein, the collection member outlet (16) is disposed above the receptacle cover member (30).

At this point the pump member (19) is activated by the switch (28) forcing the system liquid (50) through the length of hose (24) and out of the spray head member (25). The liquid spray (51) will be deposited on the user and then flow by gravity through the openings (104) between the slats (102), whereupon, the liquid will be collected by the collector member (14) and deposited by the outlet (16) onto the cover member (30) from whence it will flow through the cover member opening (31) into the interior of the sump receptacle (18).

It should also be noted in closing that this invention contemplates the fabrication of the collection member (14) from a flexible material such that the collection unit (11) and the spray unit (13) may be contained within the receptacle (18) of the sump pump unit (12) when the apparatus (10) is not in use.

Having thereby described the subject matter of this invention, it should be apparent that many substitutions, modification, and variations of the apparatus (10) are possible in light of the above teachings. It is therefore to be understood that the invention as taught and described herein is only to be limited to the extent of the breadth and scope of the appended claims.

I claim:

1. A recycling spraying apparatus for use in combination with a conventional lounge chair having a framework and slats defining openings wherein the apparatus comprises:

a collection unit including a collection member adapted to be suspended beneath said lounge chair framework wherein the collection member is provided with a fluid outlet formed at the lowest point of the collection member.

a sump pump unit including a sump receptacle containing a pump member and system fluid; and, a spraying unit adapted to be operatively connected in fluid communication with said pump member whereby system liquid propelled by said spraying unit will flow by gravity, through the openings in the slats, onto the collection member, through the fluid outlet of the collection member and back into the sump receptacle.

2. The apparatus as in claim 1 wherein said collection unit comprises:

an elongated collection member having a plurality of securing members that are adapted to engage the framework of said lounge chair.

3. The apparatus as in claim 2 wherein said collection member is fabricated from flexible material.

4. The apparatus as in claim 1 wherein the spraying unit comprises:

a generally elongated spray head member.

5. The apparatus as in claim 4 wherein the spray head member is provided with a downwardly depending support leg.

6. The apparatus as in claim 4 wherein the spray head member further comprises:

a releasable securing element formed on the spray head member, wherein the securing element is adapted to releasably engage the framework of said lounge chair.

7. The apparatus as in claim 1 wherein said sump pump unit further comprises:

a handle member operatively attached to one end of said sump receptacle.

8. The apparatus as in claim 7 wherein the sump receptacle is further provided with a recessed cover element having an enlarged opening formed proximate said one end of the sump receptacle.

9. The apparatus as in claim 8 wherein the top surface cover member is sloped towards the enlarged opening.

* * * * *